US006354865B1

(12) United States Patent
Bogese

(10) Patent No.: US 6,354,865 B1
(45) Date of Patent: Mar. 12, 2002

(54) MODULAR ELECTRICAL PLUG INCLUDING A PRINTED CIRCUIT SUBSTRATE

(75) Inventor: Stephen B. Bogese, Roanoke, VA (US)

(73) Assignee: Tyco Electronics Logistics AG, Steinach (CH)

( * ) Notice: Subject to any disclaimer, the term of this patent is extended or adjusted under 35 U.S.C. 154(b) by 0 days.

(21) Appl. No.: 09/213,831

(22) Filed: Dec. 17, 1998

(51) Int. Cl.[7] ..... H01R 4/24; H01R 4/26; H01R 11/20

(52) U.S. Cl. ..... 439/418; 439/620

(58) Field of Search ..... 439/620, 418, 439/425, 76.1

(56) References Cited

U.S. PATENT DOCUMENTS

| | | | | |
|---|---|---|---|---|
| 4,054,350 A | | 10/1977 | Hardesty | 339/99 R |
| 4,288,142 A | | 9/1981 | Anderton | 339/176 M |
| 4,412,715 A | * | 11/1983 | Bogese, II | 439/425 |
| 4,428,636 A | | 1/1984 | Kam et al. | 339/97 P |
| 4,516,825 A | | 5/1985 | Brennen et al. | 339/143 R |
| 4,533,195 A | | 8/1985 | Knickerbocker | 339/97 P |
| 4,679,879 A | | 7/1987 | Triner et al. | 439/425 |
| 4,767,355 A | | 8/1988 | Phillipson et al. | 439/425 |
| 4,950,169 A | * | 8/1990 | Martin et al. | 439/44 |
| 4,950,176 A | | 8/1990 | Cocco et al. | 439/344 |
| 4,975,078 A | | 12/1990 | Stroede et al. | 439/405 |
| 4,978,316 A | | 12/1990 | Yahata | 439/449 |
| 5,147,215 A | | 9/1992 | Pritulsky et al. | 439/344 |
| 5,179,779 A | | 1/1993 | Iura et al. | 29/877 |
| 5,186,647 A | | 2/1993 | Denkmann et al. | 439/395 |
| 5,186,649 A | | 2/1993 | Fortner et al. | 439/460 |
| 5,194,014 A | | 3/1993 | McClune et al. | 439/404 |
| 5,284,447 A | | 2/1994 | Kristiansen | 439/425 |
| 5,305,380 A | | 4/1994 | Hileman et al. | 379/445 |
| 5,310,363 A | | 5/1994 | Brownell et al. | 439/676 |
| 5,385,484 A | | 1/1995 | Bartle et al. | 439/468 |
| 5,415,567 A | | 5/1995 | Fusselman et al. | 439/344 |
| 5,421,741 A | * | 6/1995 | David et al. | 439/405 |
| 5,431,584 A | | 7/1995 | Ferry | 439/620 |
| 5,432,484 A | | 7/1995 | Klas | 333/1 |
| 5,538,438 A | | 7/1996 | Orlando | 439/344 |
| 5,556,295 A | | 9/1996 | McFadden et al. | 439/301 |
| 5,571,035 A | | 11/1996 | Ferrill | 439/894 |
| 5,580,270 A | | 12/1996 | Pantland et al. | 439/395 |
| 5,593,314 A | | 1/1997 | Lincoln | 439/418 |
| 5,628,647 A | | 5/1997 | Rohrbaugh et al. | 439/404 |
| 5,727,962 A | | 3/1998 | Caveney et al. | 439/344 |
| 5,971,812 A | * | 10/1999 | Martin | 439/676 |
| 6,007,368 A | * | 12/1999 | Lorenz et al. | 439/418 |

FOREIGN PATENT DOCUMENTS

| | | |
|---|---|---|
| DE | 2345149 | 12/1972 |
| DE | 3918517 | 6/1990 |
| GB | 2249222 | 4/1992 |

* cited by examiner

*Primary Examiner*—Neil Abrams
*Assistant Examiner*—Javaid Nasri
(74) *Attorney, Agent, or Firm*—Hoffmann & Baron, LLP

(57) ABSTRACT

An electrical connector which incorporates a printed circuit substrate to accurately modify electrical signals on the cable terminated in the connector. The connector utilizes two distinct sets of contact terminals, the first set acting to terminate the cable and the substrate, the second set acting to terminate the substrate and couple the signals thereon to a mating external jack. The substrate includes circuit components electrically connected between the first and second sets of contact terminals.

18 Claims, 10 Drawing Sheets

MODULAR ELECTRICAL PLUG INCLUDING A PRINTED CIRCUIT SUBSTRATE

BACKGROUND OF THE INVENTION

I. Field of the Invention

The present invention relates to electrical connectors and, more particularly, is directed towards a modular telephone plug type of electrical connector.

II. Description of Related Art

In my prior U.S. Pat. No. 4,412,715, I describe a standard modular plug of the type commonly used in both telephone equipment and other cable interconnect applications. My earlier '715 patent is directed towards a thin, flexible substrate that is positioned within the plug which includes at least one conductive path positioned on the substrate adjacent to one or more of the insulated conductors terminated by the plug. An insulation-piercing contact terminal pierces a segment of the path on the substrate, as well as one of the insulated conductors, to provide electrical connections thereto.

In one embodiment, illustrated in FIG. 7 of the '715 patent, there is described a U-shaped conductive path 172 that includes a longitudinal segment positioned under one insulated conductor, another longitudinal segment positioned under another insulated conductor, and a transverse segment connecting the two longitudinal segments. I teach that an electrical or electronic component 186 may be included in the transverse segment, and that such component may be an active device (e.g., a transistor, integrated circuit, microprocessor, etc.) or a passive device (e.g., resistor, etc.). It is disclosed in column 9 between lines 9 and 45 that a signal from one contact terminal 156 must travel through the electrical component 186 before reaching the other contact terminal 166. Each of the contact terminals pierce a respective one of the longitudinal segments and its associated insulated conductor.

While the above-described configuration is useful, I have found it to be quite limited in that each of the relevant contact terminals terminate both the insulated conductors and the conductive paths of the printed circuit, such that the electrical component 186 can only indirectly alter or filter the signal. If, for example, electrical signals appear on both of the insulated conductors 138 and 148 that are terminated by the respective contact terminals 156 and 166, electrical component 186 will act on both such signals simultaneously. Further, the precise manner in which component 186 acts on such signals is somewhat unpredictable, and it depends on the signals themselves and their relationship to each other at any given point in time.

It may therefore be appreciated that it would be highly desirable if an arrangement could be devised whereby alteration of the signal appearing on an insulated conductor in the plug could be more carefully and precisely controlled. It is towards this end that the present invention is advanced.

OBJECTS AND SUMMARY OF THE INVENTION

It is therefore a primary object of the present invention to provide a new and improved electrical connector which utilizes a printed substrate in such a manner so as to more accurately and precisely control the alteration of a signal received by the cable terminated in the connector.

Another object of the present invention is to provide a new and improved version of a modular electrical plug having a conductive path over that described in my prior U.S. Pat. No. 4,412,715.

Yet another object of the present invention is to provide a novel and unique electrical connector which incorporates a flexible substrate having a printed circuit pattern and electrical components thereon, in such a manner so as to achieve more precise signal modification in a predetermined manner.

The foregoing and other objects are achieved in accordance with one aspect of the present invention through the provision of an electrical connector, which comprises a dielectric housing, a plurality of insulated conductors positioned in the housing, and a thin flexible substrate positioned in the housing adjacent to the insulated conductors and having a plurality of pairs of electrically conductive sectors thereon. There is further provided insulation-piercing contact terminal means positioned in the housing for making electrical contact with at least one of the insulated conductors and at least one of the pairs of segments and for permitting an electrical connection to be made thereto externally of the housing.

In accordance with more specific aspects of the present invention, the thin, flexible substrate further includes a plurality of electrical components, each of which is connected between a pair of electrically conductive segments so as to modify the electrical signals passing therethrough.

In accordance with more specific aspects of the present invention, the insulation-piercing contact terminal means comprises first and second substantially planar contact terminals positioned in the housing in substantially the same plane. Each of the plurality of pairs of electrically conductive segments includes first and second discrete segments, the first contact terminal making electrical contact with one of the insulated conductors and the first discrete segment, the second contact terminal making electrical contact with the second discrete segment while providing an electrical connection thereto externally of the housing.

In accordance with another aspect of the present invention, there is provided an electrical connector which comprises a dielectric housing, a plurality of insulated conductors positioned in the housing, a first plurality of contact terminal means positioned in the housing for piercing the insulation of the plurality of insulated conductors in order to make electrical contact therewith, and a second plurality of contact terminal means positioned in the housing for not piercing the insulation of any of the plurality of insulated conductors but for permitting an electrical connection to be made thereto externally of the housing.

In accordance with more specific aspects of the present invention, the contact terminal means, each comprised of substantially planar, electrically conductive contact terminals, have tangs at the lower end thereof for enabling insulated conductors to be pierced, and a spring-contact mateable surface at the other end thereof for enabling contact portions of a mating connector to be coupled thereto. The first plurality of contact terminal means are aligned in a first row, and the second plurality of contact terminal means are aligned in a second row, the first and second rows being substantially parallel to each other. One of the first plurality of contact terminal means is in substantially the same plane with one of the second plurality of contact terminal means.

In accordance with yet another aspect of the present invention, the contact terminals of the first and second Plurality of contact terminal means are positioned in aligned pairs consisting of one contact terminal from the first plurality and one contact terminal from the second plurality, each of the aligned pairs of contact terminals being positioned in substantially the same plane.

In accordance with yet another aspect of this invention, means are provided in the housing for electrically connecting the first and second plurality of contact terminal means, such means comprising substrate means positioned in the housing and having electrically conductive path means positioned thereon. The path means is more particularly adapted to be pierced by the first and second plurality of contact terminal means. More particularly, the path means comprises first and second sets of electrically conductive paths, the first set of paths adapted to be pierced by the first plurality of contact terminal means, the second set of paths adapted to be pierced by the second plurality of contact terminal means.

The substrate means may further include a plurality of first electrical components positioned thereon and coupled to the first and second sets of electrically conductive paths. Further, there may be provided a second electrical component coupled between one of the paths of the first set and one of the paths of the second set. The first and second components may be connected in series.

In accordance with yet another aspect of the present invention, there is provided an electrical connector which comprises a dielectric housing, electrical conductor means positioned in the housing, substrate means positioned in the housing having electrically conductive path means and electrical component means positioned thereon, first means for electrically coupling the electrical conductor means and the path means, and second means, distinct and separate from the first means, for electrically coupling the path means to an external contact of a mating connector. More particularly, the electrical conductor means provides a first signal which is electrically coupled by the first means through the path means and the component means, the component means including modifying means from the first signal to produce a second signal which is electrically coupled by the second means to the external contact of a mating connector.

In accordance with more specific aspects of this invention, the path means includes first and second electrically conductive paths, the electrical component being connected in series between the first and second electrically conductive paths. Further, the electrical conductor means preferably comprises an insulated conductor, while the first means comprises a first contact terminal having tangs for piercing the insulation of the insulated conductor and the first electrically conductive path. Furthermore, the second means comprises a second contact terminal having tangs for piercing the second electrically conductive path on the substrate means. The second contact terminal does not pierce the insulation of the insulated conductor.

In accordance with yet another aspect of the present invention, there is provided an electrical connector which comprises a dielectric housing, an insulate conductor positioned in the housing, substrate means positioned in the housing having first and second discrete electrically conductive paths positioned thereon, electrical components connected between the first and second paths, first electrically conductive terminal means in the housing for piercing the insulated conductor and the first path, and second electrically conductive contact terminal means positioned in the housing for piercing the second path and for permitting an electrical connection to be made thereto externally of the housing. The first and second electrically conductive contact terminal means preferably comprise first and second pluralities of substantially planar contact terminals, each of the contact terminals having tangs at the lower ends thereof capable of piercing the insulation of the conductor. The first and second pluralities of contact terminals are preferably positioned in two adjacent, substantially parallel rows, respectively.

BRIEF DESCRIPTION OF THE DRAWINGS

The foregoing and other objects, aspects and features of the present invention will be more fully appreciated as the same becomes better understood when considered in connection with the following detailed description of the present invention viewed in conjunction with the accompanying drawings, in which.

DETAILED DESCRIPTION OF THE PREFERRED EMBODIMENT

Figure 1:
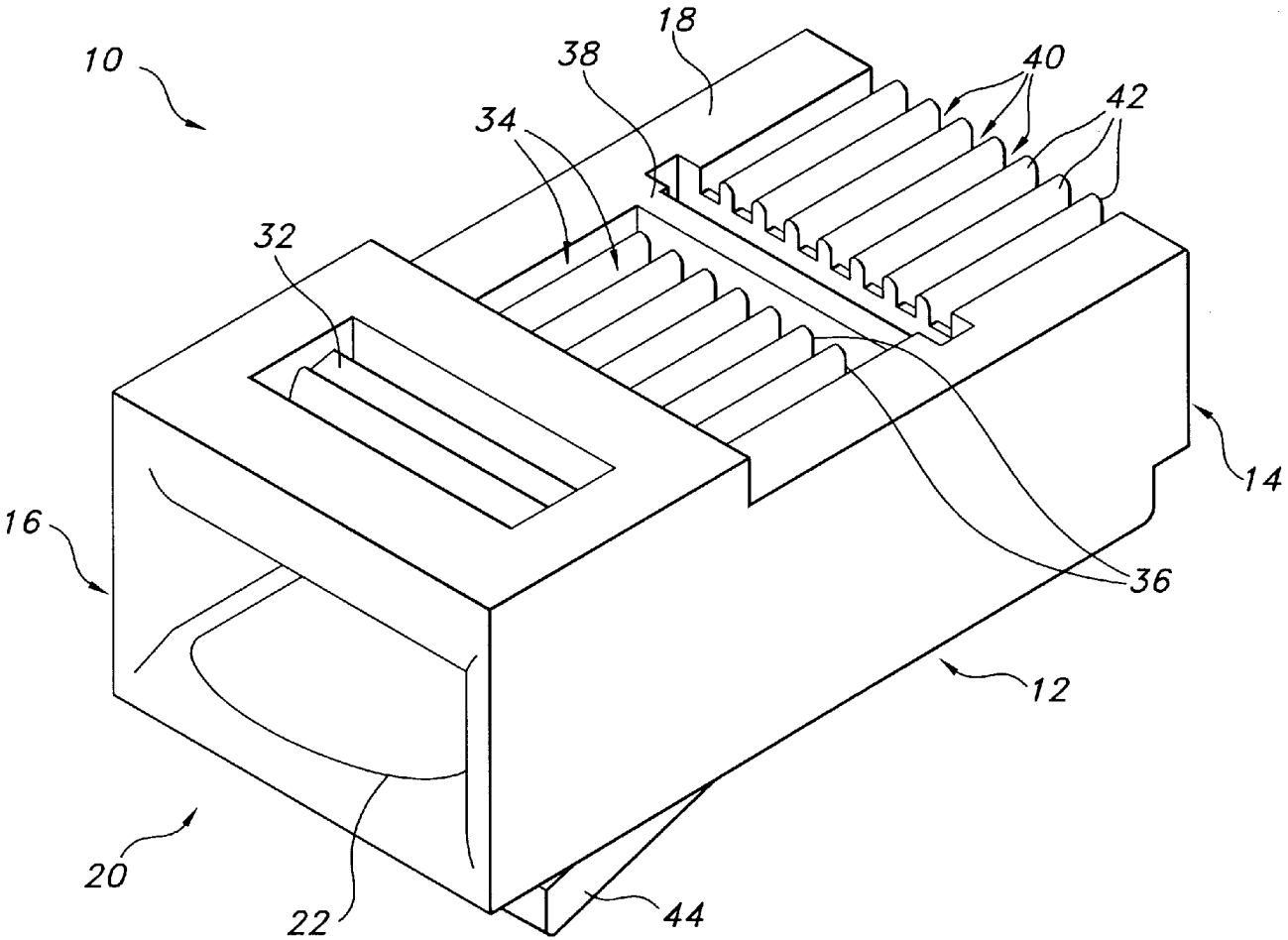
FIG. 1 is a top, perspective view of a preferred embodiment of a modular plug of the present invention.

Referring now to the drawings, wherein like reference numerals indicate identical or corresponding parts throughout the several views, and more particularly to FIGS. 1–4 thereof, there is illustrated a preferred embodiment of the present invention which includes a modular connector or plug indicated generally by reference numeral 10.

Plug 10 comprises a unipartite housing 12 which is specifically adapted to terminate a multi-conductor cable (not shown in FIGS. 1–4). Modular plug 10 in this preferred embodiment generally includes features which are generic to a standard modular plug of the type commonly used in both telephone equipment and other cable interconnect applications. A standard modular telephone plug having similar features is set forth, for example, in U.S. Pat. Nos. 3,954,320 and 3,998,514, both of which are expressly incorporated herein by reference. Another version of a standard, miniature modular plug is set forth in my earlier U.S. Pat. No. 4,412,715. However, as will be appreciated hereinafter, the modular plug 10 of the present invention contains important structural and functional modifications when compared with the referenced prior art modular plugs.

Housing 12 of plug 10 includes a free end 14 which is adapted to be inserted into a mating modular jack such as the device described in U.S. Pat. No. 3,850,497, which is expressly incorporated herein by reference. Such a jack typically includes a plurality of side-by-side spring contact members which are placed in a cavity adapted to receive free end 14 of plug 10 for making electrical contact with certain of the plug's contact terminals, as will be described in greater detail below.

Housing 12 also includes a cord or cable input end 16 as well as a terminal receiving side 18. The cable input end 16 includes a cord receiving cavity 20 into which a multi-conductor cable may be placed.

Figure 2:
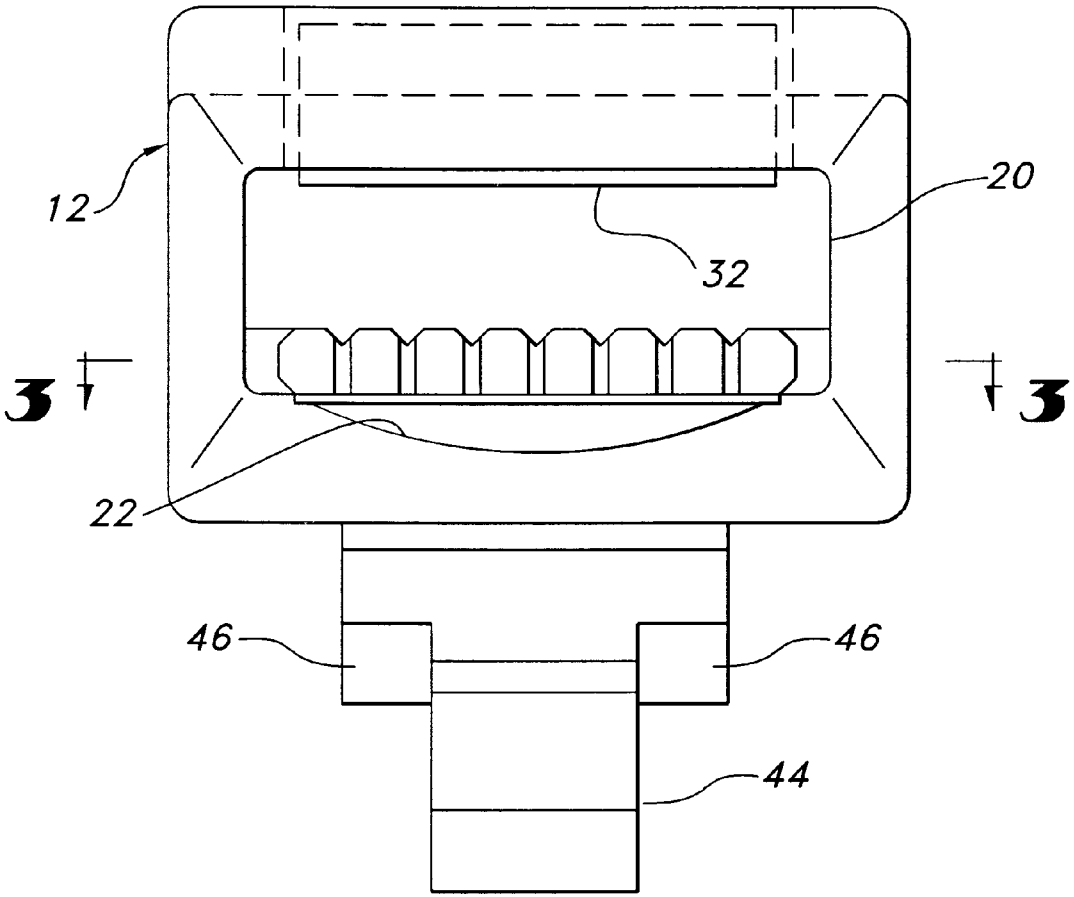
FIG. 2 is a rear view in elevation of the preferred embodiment of FIG. 1.
Figure 3:
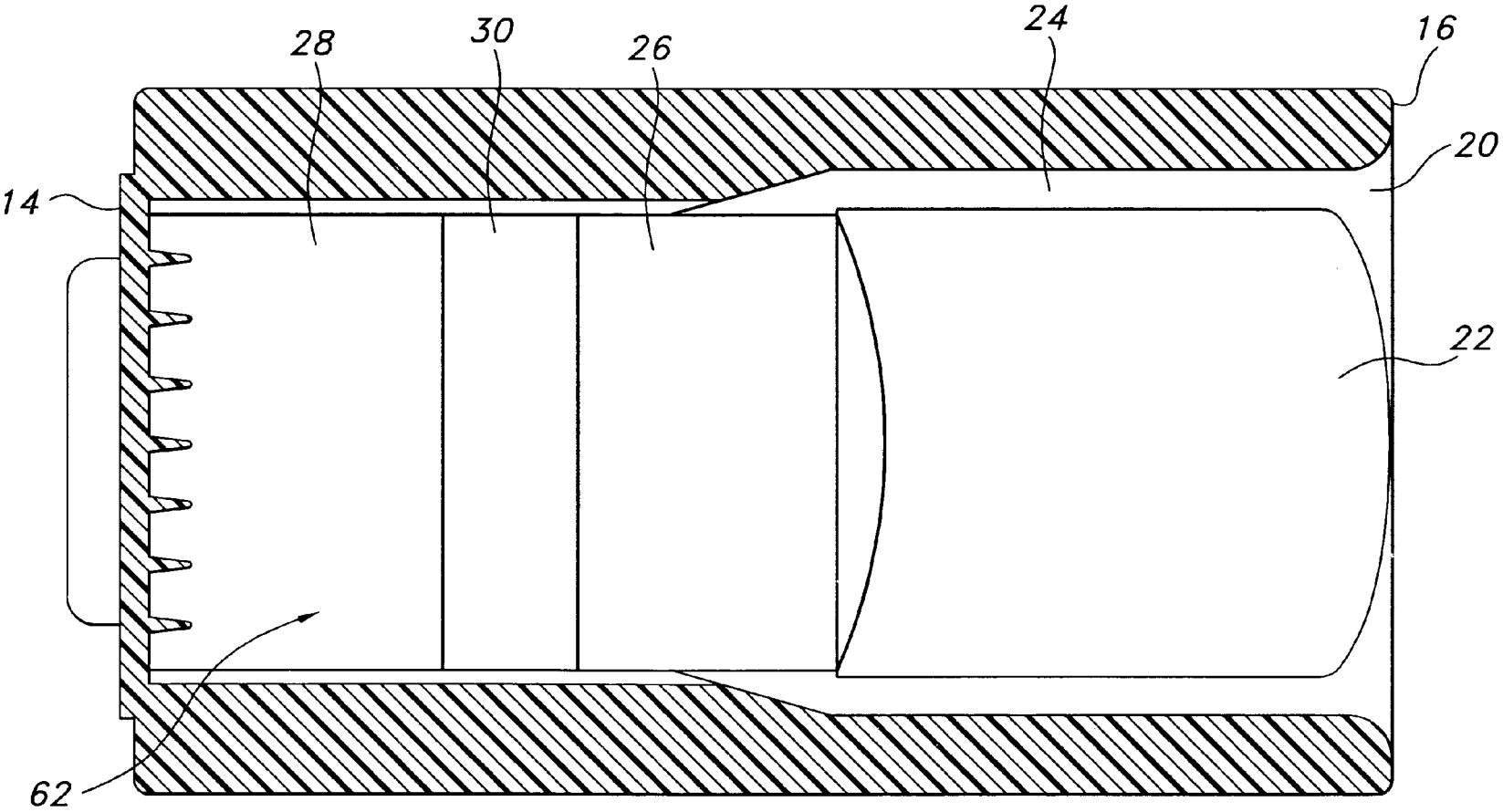
FIG. 3 is a cross-sectional view taken along line 3—3 of FIG. 2.

As shown in FIGS. 1–3, cord receiving cavity 20 includes a lower, cable-receiving trough 22 which comprises a semi-depression in the lower wall of cavity 20 against which the outer jacket of the cable rests.

As may be seen in FIG. 3, cord-receiving cavity 20 includes a relatively wide, rear cable-receiving portion 24, a middle conductor-receiving portion 26 located forwardly of portion 24, and a terminal-receiving portion 28 located at the forwardmost portion of housing 12 near the free end 14 thereof. Positioned between conductor-receiving portion 26 and terminal-receiving portion 28 is a component-receiving portion 30.

Portions 26, 28 and 30 together define a substrate-receiving portion indicated generally by reference numeral 62, which is provided for a purpose that will be described in greater detail hereinafter.

Figure 4:
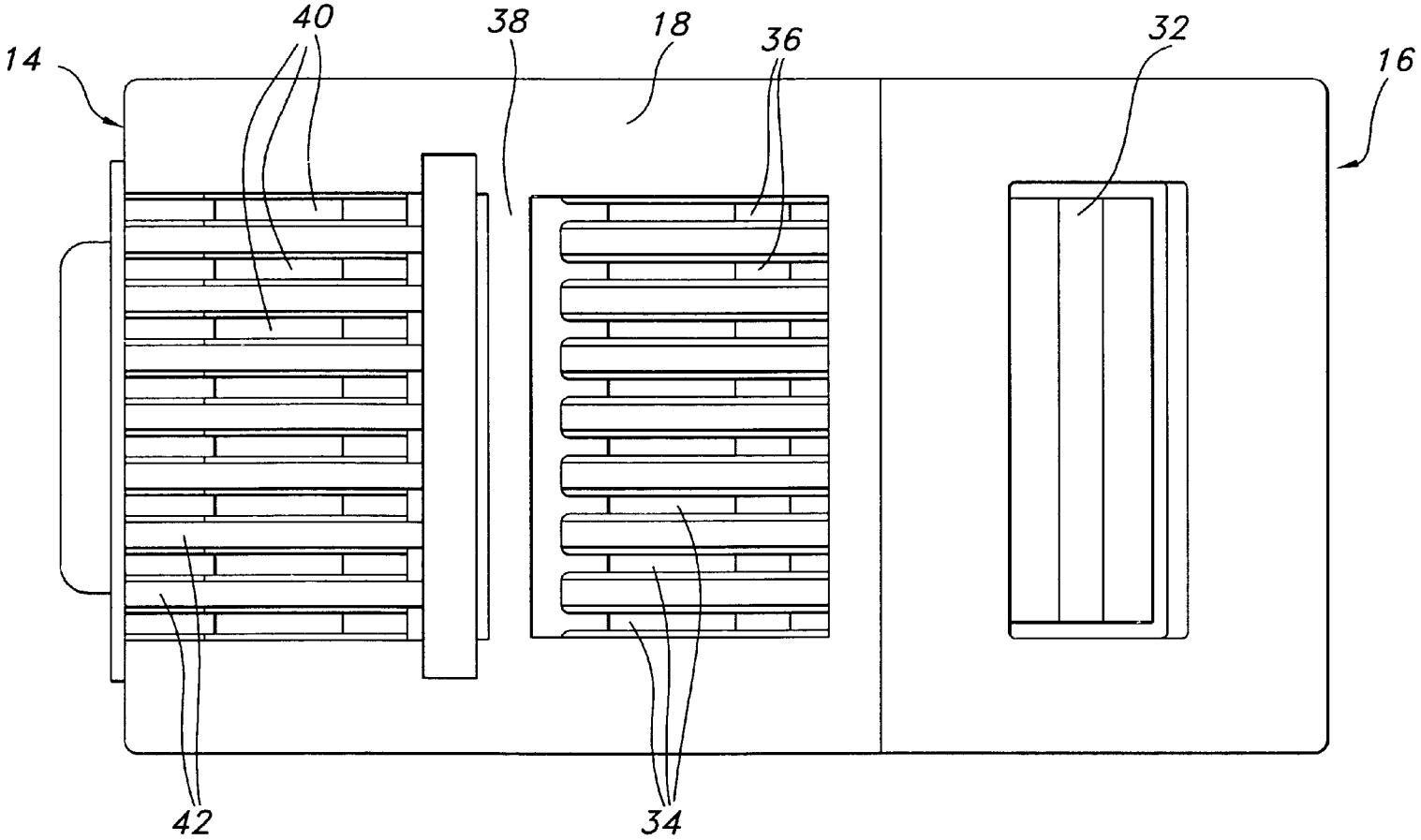
FIG. 4 is a top, plan view of the preferred embodiment of the modular plug of the present invention.

Referring now to FIGS. 1 and 4, in the top of housing 12, adjacent the cord-receiving cavity 20, is positioned a jacket anchoring member 32 which conventionally is connected to the housing by a hinge and includes a snap-lock ledge that forces member 32 against the outer jacket of the cable to provide strain relief, all of which is quite conventional.

Formed in the middle portion of housing 12 on the terminal-receiving side 18 is a first set of terminal-receiving slots 34 which are defined by a first set of terminal partitions 36. Slots 34 are each sized so as to receive therein a standard, planar contact terminal that will be described below.

Positioned adjacent the first set of slots 34 is a transverse partition member 38. On the other side of partition member 38 are positioned a second set of terminal-receiving slots 40 which are, in turn, defined by a second set of terminal partitions 42 arranged side-by-side in a manner similar to terminal partitions 36. Slots 40 likewise are each sized so as to receive a standard contact terminal, as will be described below. Further, the first and second sets of terminal receiving slots 34 and 40 are positioned on terminal receiving side 18 of housing 12 so as to be in substantial alignment with each other, as best seen in FIG. 4.

Referring back to FIG. 2, housing 12 also includes a standard locking tab or latching arm 44 which is pivotally mounted to the bottom wall of housing 12. Alternatively, it may be mounted to either side wall. As is conventional, latching arm 44 includes a pair of spaced shoulders 46 which are adapted to be secured by similarly spaced shoulder retaining members in the mating modular jack (not shown).

Figure 5:
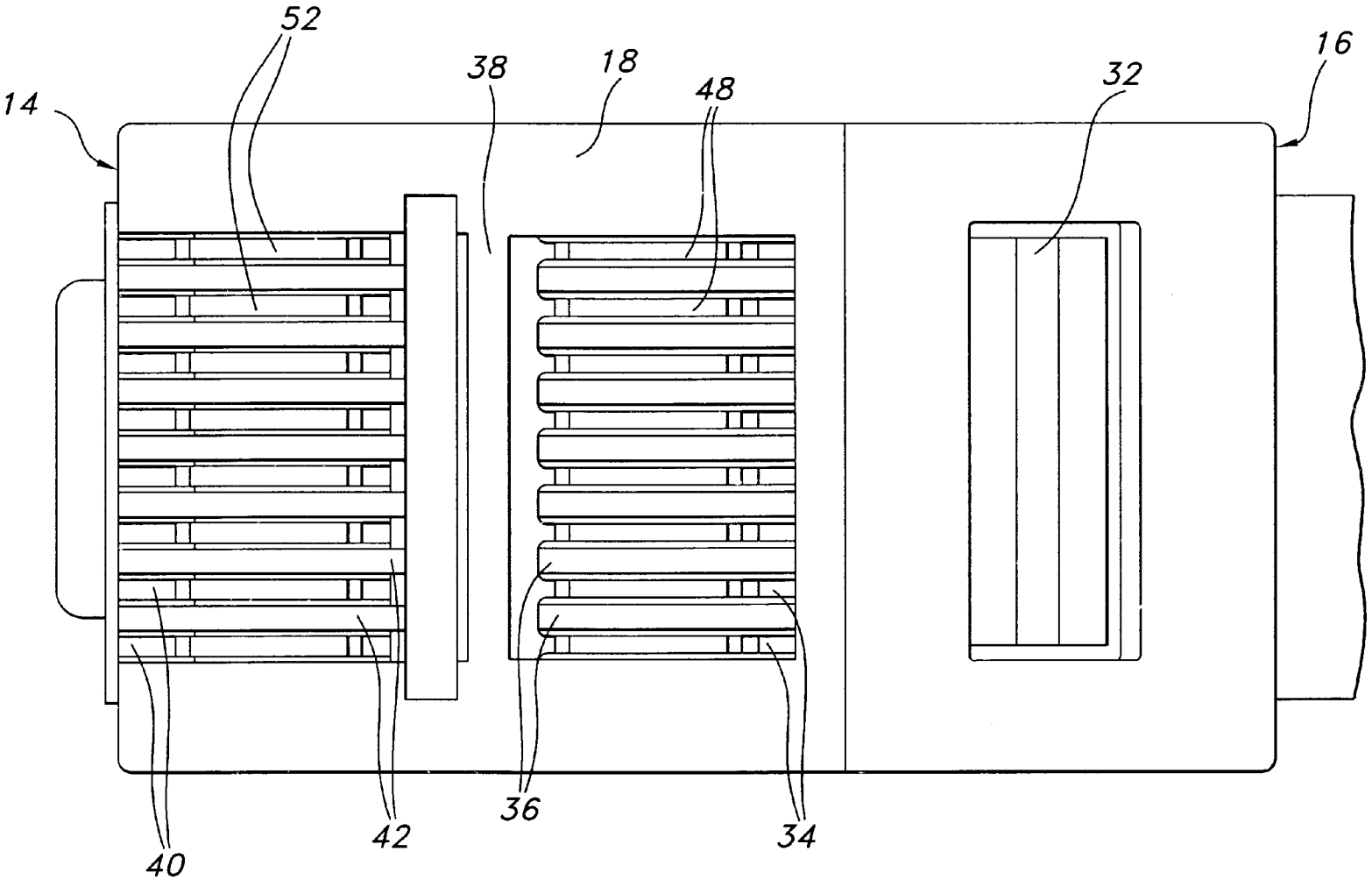
FIG. 5 is a top view similar to FIG. 4 but showing the presence of contact terminals and multi-conductor cable.
Figure 6:
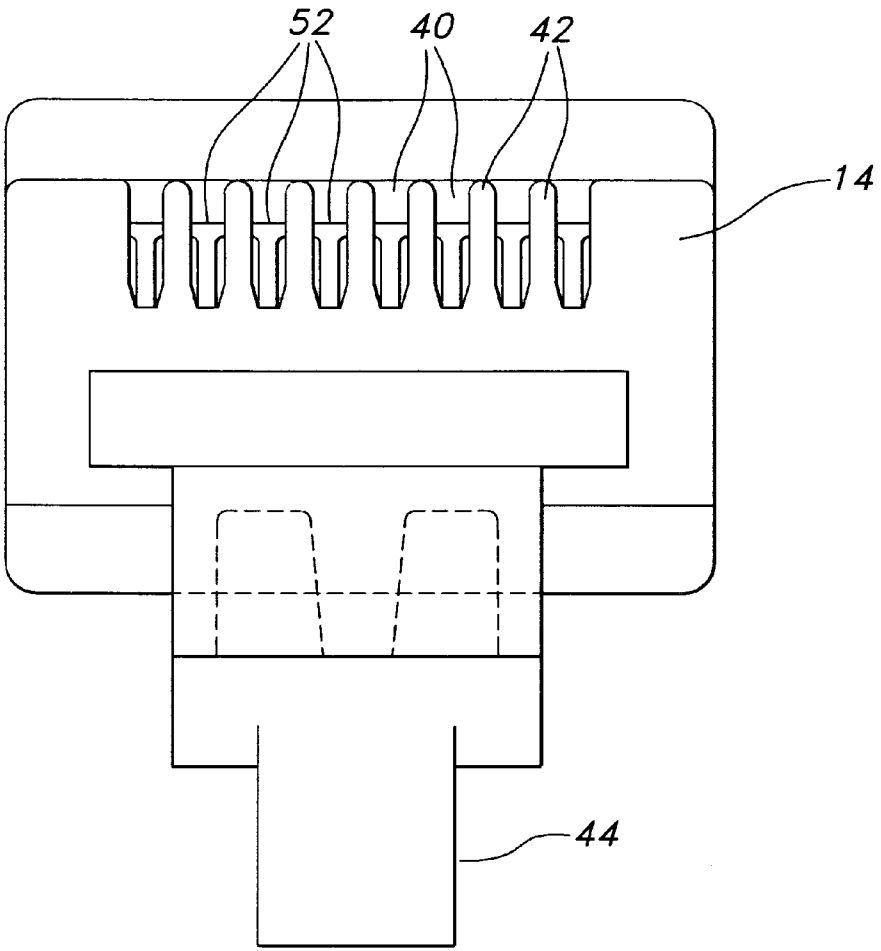
FIG. 6 is a front view in elevation of the preferred embodiment illustrated in FIG. 5.

Referring now to FIGS. 5 and 6, they correspond respectively to FIGS. 4 and 2, except that FIGS. 5 and 6 illustrate the plug 10 of the present invention with a multi-conductor cable 50 installed therein. Multi-conductor cable 50 generally includes an outer jacket that surrounds a plurality of individually insulated conductors. Referring to FIG. 5, there are illustrated a first set of contact terminals 48 positioned in the first set of side-by-side terminal-receiving slots 34. Similarly, a second set of contact terminals 52 are shown positioned in the second set of side-by-side terminal-receiving slots 40. FIG. 6 illustrates the free end 14 of plug 10 as well as the second set of contact terminals 52 located in slots 40 which are defined by the second set of terminal partitions 42.

Figure 7:
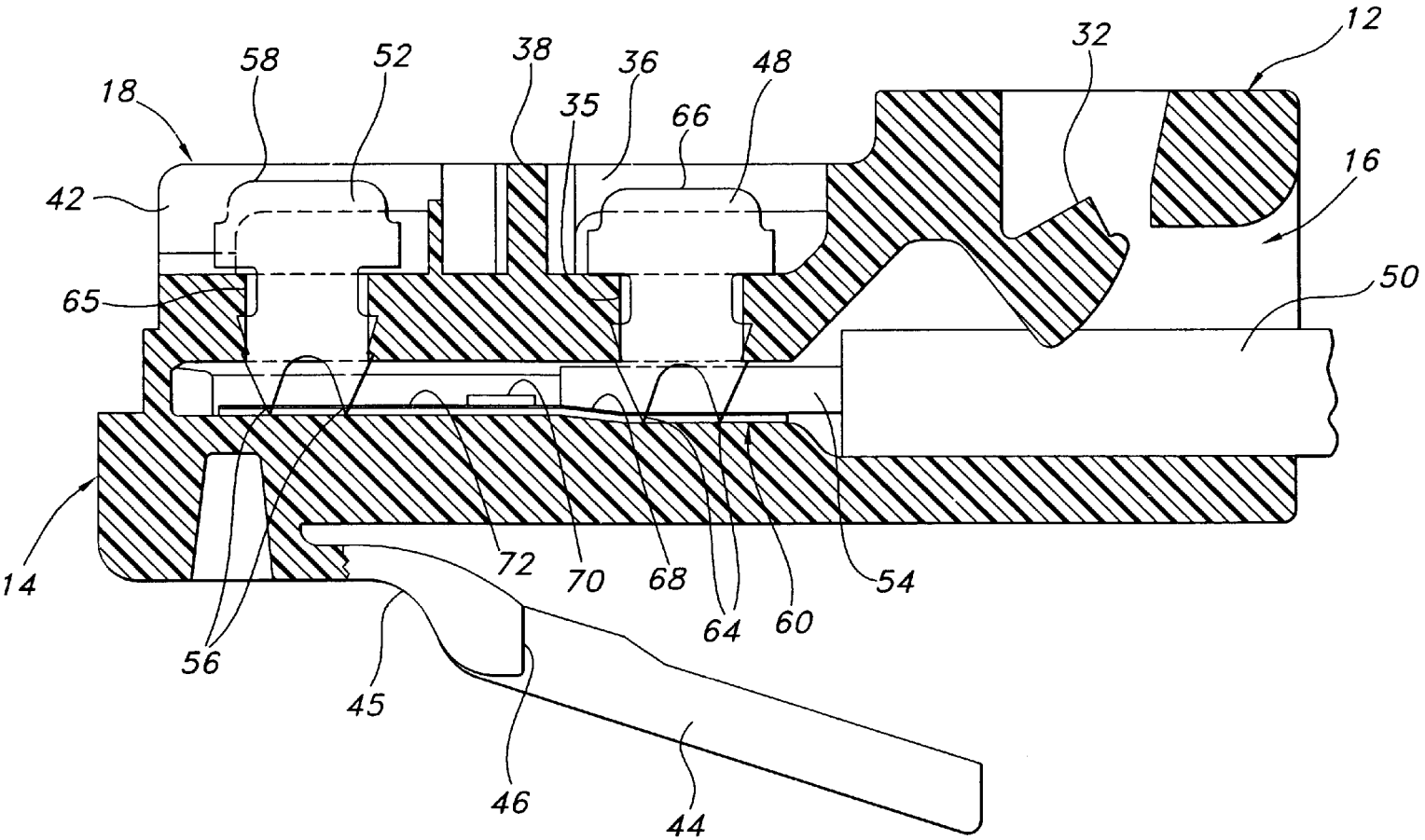
FIG. 7 is a longitudinal sectional view of the embodiment illustrated in FIGS. 5 and 6 showing a multi-conductor cable terminated in the preferred embodiment of the present invention.

FIG. 7 is a longitudinal sectional view of the structure illustrated in FIG. 5 wherein it may be appreciated that multi-conductor cable 50 includes a plurality of insulated conductors 54 that are terminated generally in the conductor-receiving portion 26 of the connector. Also illustrated in FIG. 7 is the pivotal mount 45 of the rearwardly extending latching arm 44.

FIG. 7 also illustrates the general structure of a preferred embodiment of the first and second set of contact terminals 48 and 52. Each of the contact terminals, such as contact terminal 52, includes conductor-piercing tangs 56 at the lower end thereof and a spring-contact mateable surface 58 at the other end thereof which is adapted to come into contact with the similarly-spaced spring contact portion of the mating modular jack, as described above. Contact terminals 48 and 52 are held in place respectively within slots 34 and 40 by a press or interference fit within the reduced portions 55 and 65 of slots 34 and 40, respectively.

Contact terminal 48 may be substantially identical in form to contact terminal 52. That is, contact terminal 48 preferably includes a pair of conductor-piercing tangs 64 at the lower end thereof and a spring-contact mateable surface 66 at the upper end thereof. However, surfaces 66 of contact terminals 48 are not intended in this embodiment to mate with spring contact portions of a mating jack, in contrast to the surfaces 58 of contact terminals 52. More particularly, contact terminals 48 are provided inter alia to terminate the insulated conductors 54 of cable 50, in a manner which will be described in greater detail hereinafter.

In accordance with the present invention, a thin-flexible substrate indicated generally by reference numeral 60 is positioned within substrate-receiving portion 62 of housing 12. Substrate 60 is preferably positioned below conductors 54 which overlie approximately ⅓ to ½ of the overall length of substrate 60, as seen clearly in FIG. 8. Substrate 60 in this embodiment is generally rectangular and formed of a thin (e.g., 0.0005 inch–0.002 inch) plastic, such as a polyester film, and is sized so as to be interference or press fit along the edges thereof with the side walls that form substrate-receiving portion 62. The thickness of substrate 60 will in part be selected according to the size of portion 62 and the diameter of insulated conductors 54. Substrate 60 is preferably flexible so as to be easily manipulated and well-fit within substrate receiving portion 62.

Figure 8:
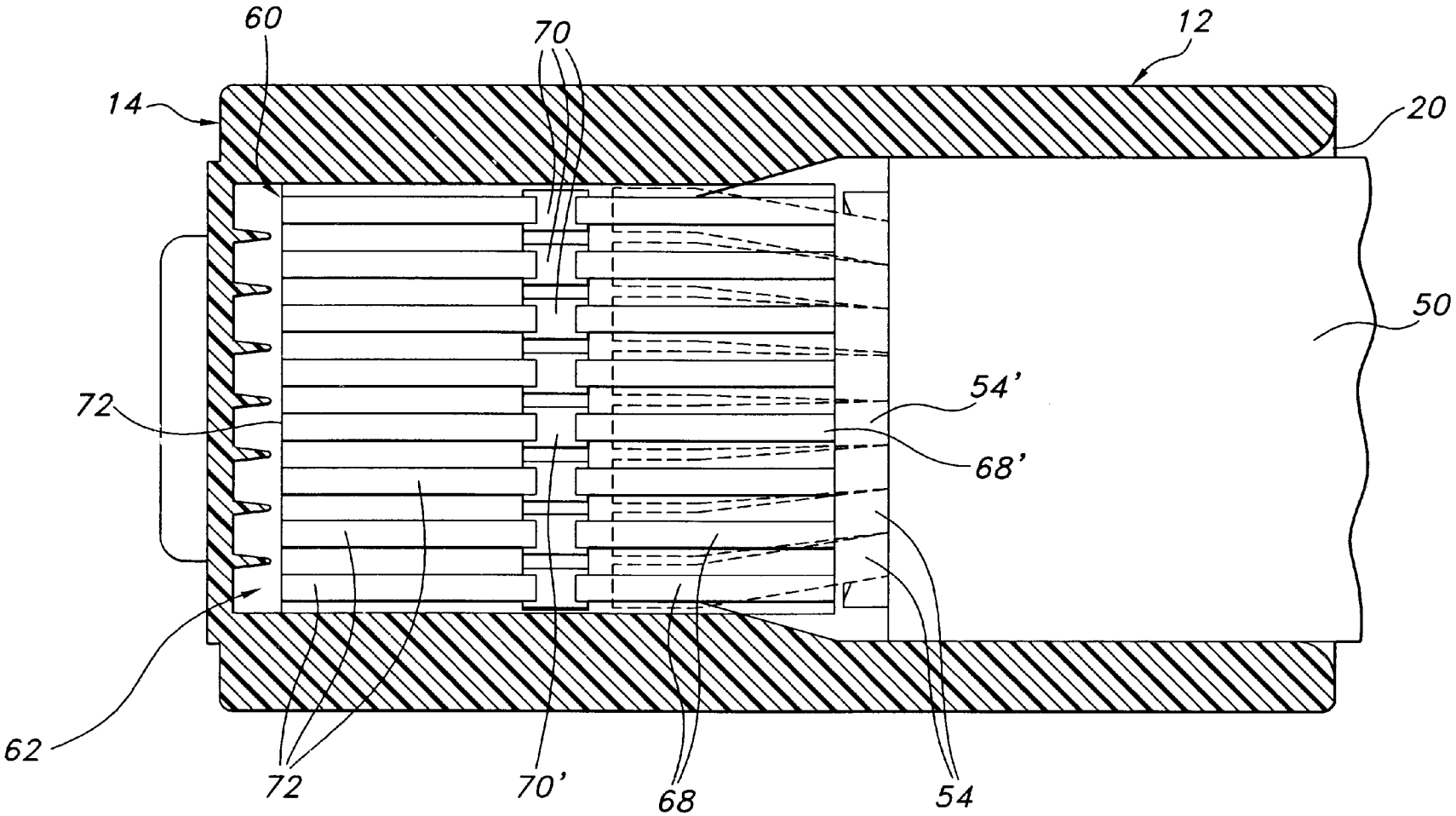
FIG. 8 is a sectional view similar to FIG. 3 but illustrating the presence of a multi-conductor cable in the preferred embodiment of the present invention.

Referring now to FIG. 8, it is a view similar to FIG. 3 but shows the substrate 60 of the present invention together with a multi-conductor cable 50 both in position within housing 12. Formed on the upper surface of substrate 60 (or, alternatively, on the bottom surface, or on both surfaces thereof) by any conventional technique is a first set of metal traces or conductive paths 68. Details concerning the dimensions of the conductive paths, the thicknesses thereof, and the manner of formation of same are fully described in my earlier U.S. Pat. No. 4,412,715, the specification of which is expressly incorporated herein by reference.

In this improvement over my earlier '715 patent, there are provided two distinctly separate sets of conductive paths: the first is designated by reference numeral 68 which, as noted above, are formed at one end of substrate 60 in alignment with the position of insulated conductors 54 which overlie same.

Positioned at the other end of substrate 60, and in alignment with the first set of conductive paths 68, is a second set of metal traces or conductive paths 72. Again, traces 72 may be substantially identical in size to the aligned first set of traces 68. The second set of traces 72 are also positioned so that each trace underlies a respective one of the second set of terminal-receiving slots 40, and hence contact terminals 52, as will be described in more detail below.

Located between the first and second set of traces 68 and 72 are a plurality of electrical or electronic components 70 which are selected and designed to act in a specific manner upon the electrical signals received from insulated conductors 54.

Each of the individual components 70 are electrically connected to adjacent ends of traces 68 and 72 to form an electrical series circuit. Of course, the components 70 may be the same or different components, and may or may not be provided in each of the individual positions on the substrate, as may be desired for a particular application. Certain electrical components 70 may comprise, for example, simple resistors, while other components may comprise active devices, such as transistors or integrated circuits. Any suitable electrical or electronic component may be selected that acts in the desired predictable, specific manner upon an electrical signal that is desired to be modified.

It may be appreciated from FIGS. 7 and 8 that the first set of contact terminals 48 terminate each of the individual insulated conductors 54 as well as the underlying first set of conductive paths 68 on substrate 60. Thus, the electrical signals appearing on insulated conductors 54 are electrically coupled, via contact terminals 48, to the first set of metal traces 68.

It also may be appreciated from FIGS. 7 and 8 that the second set of contact terminals 52 serve the function of piercing and thereby terminating the second set of conductive paths 72 such that any signal appearing on paths 72 is transmitted through contact terminals 52 to the spring-contact terminals of the mating modular jack (not shown). Thus, contact terminals 52 are used as terminating devices for substrate 60, but are not designed to terminate the insulated conductors 54.

In a similar vein, contact terminals 48 are used to terminate the insulated conductors 54, but are not used to couple the signals therefrom to any external mating modular jack. Rather, contact terminals 48 couple the signal from conductors 54 to the substrate 60.

Positioned between traces 68 and 72 are electrical components 70 which respectively act on the input signals from traces 68 so as to modify them in a predetermined manner. The modified signals are then fed to the output traces 72 so as to be coupled to an output device via contact terminals 52, as described above. In this manner, the incoming signals on cable 50, appearing on individual insulated conductors 54, may be modified in a precise, predetermined manner by preselected electrical components 70 before being output to a mating modular jack.

Figure 9:
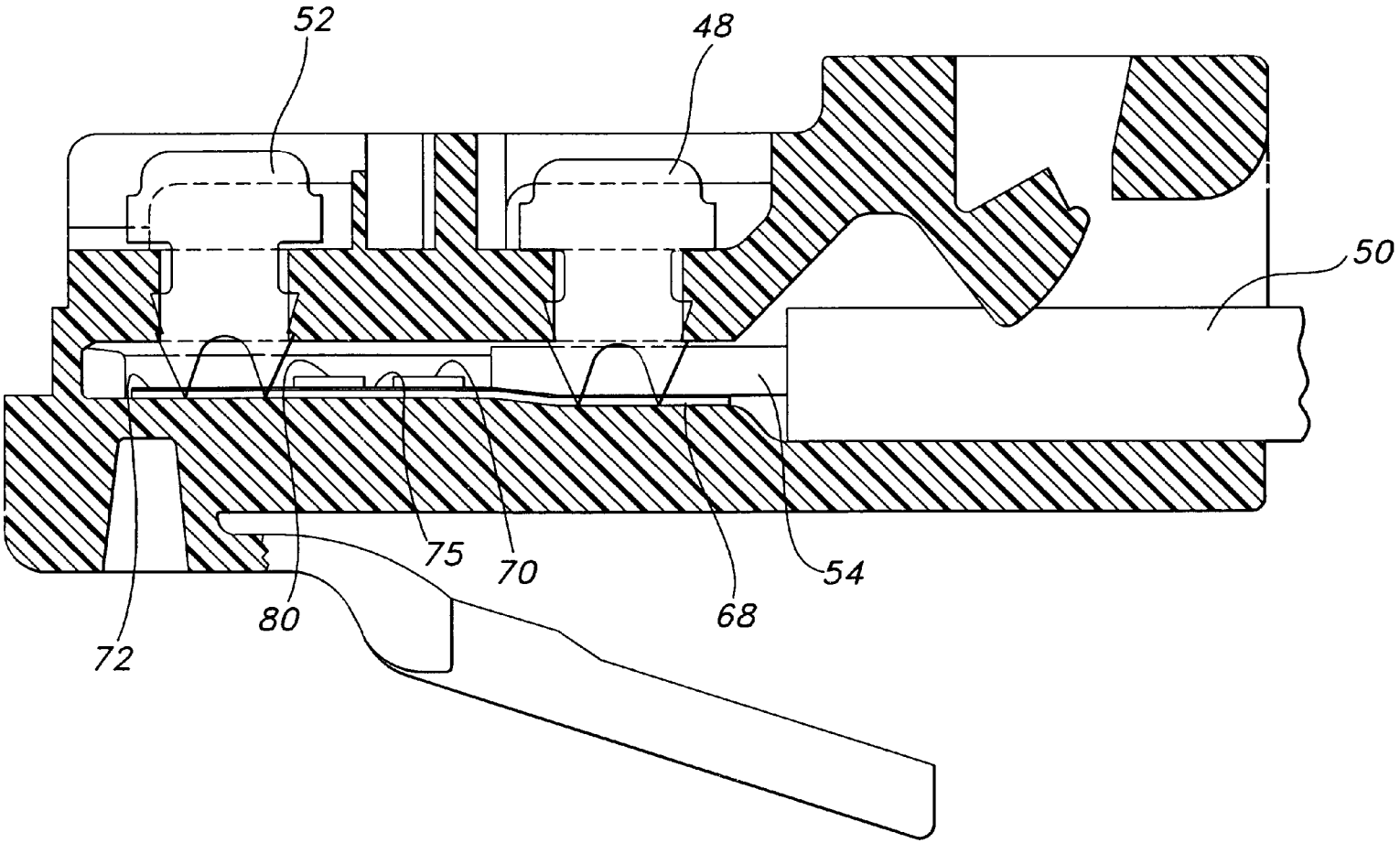
FIG. 9 is a longitudinal sectional view similar to FIG. 7 but illustrating a second embodiment of the present invention.
Figure 10:
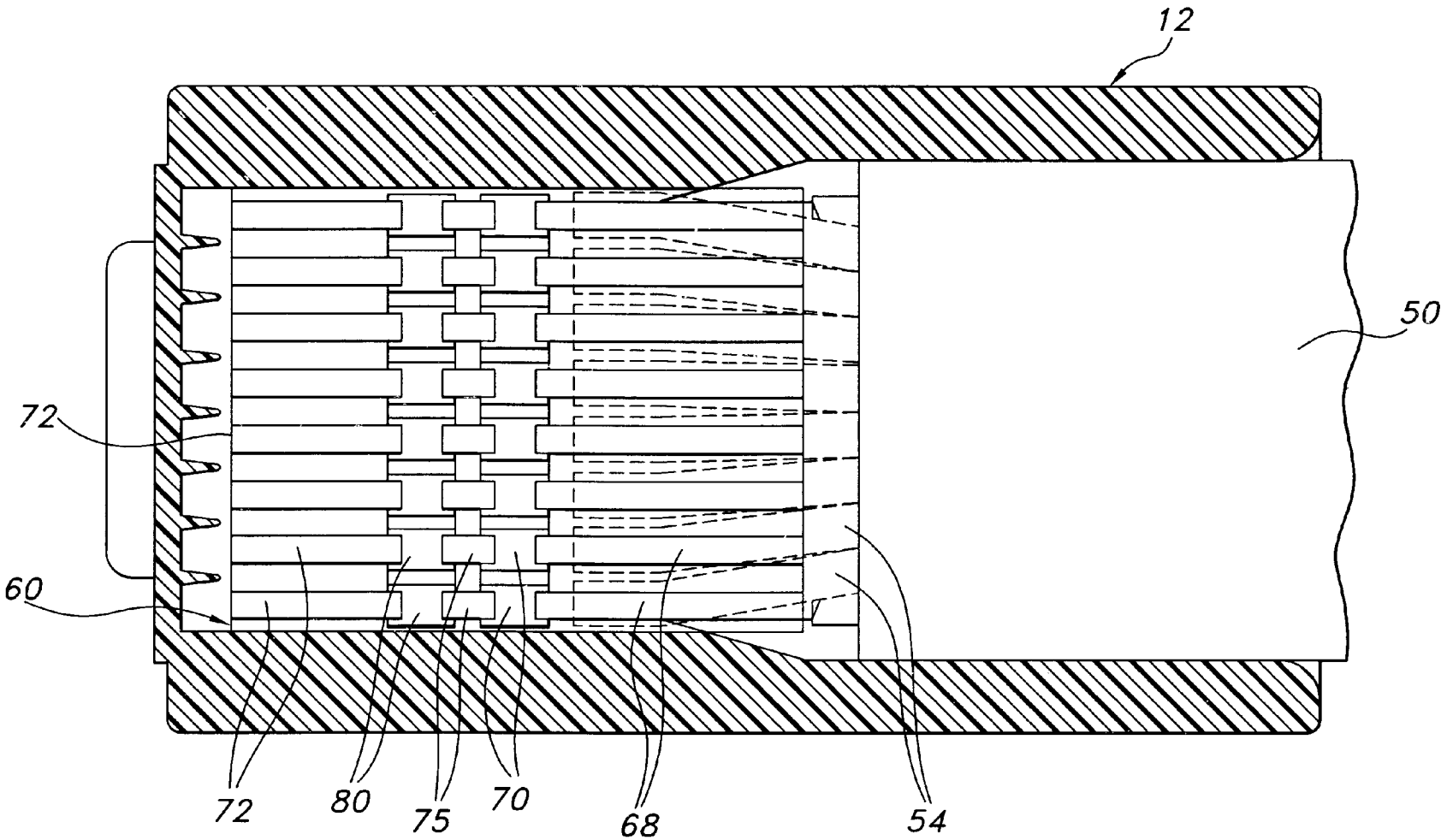
FIG. 10 is a sectional view similar to FIG. 8 but illustrating the second preferred embodiment of the present invention.

Referring now to FIGS. 9 and 10, there is illustrated a second embodiment of the present invention. This second embodiment is quite similar to the first embodiment shown in FIGS. 7 and 8. However, in addition to the first set of electrical components 70, there is provided on substrate 60 a second set of electrical components 80 which are preferably series connected to the first set of components 70 by connecting traces or conductive paths 75.

In this embodiment, the incoming electrical signals along insulated conductors 54 may be modified both by the first set of electrical components 70 and the second set of electrical components 80 before being output to the mating modular jack (not shown). This provides an additional degree of design capability to the present invention.

Obviously, numerous modifications and variations of the present invention are possible in light of the above teachings. For example, the electrical components 70 and/or 80 may be vastly different, one from the other, depending on the desired application. In addition, the present invention may be used in other electrical connectors, such as sub-miniature D connectors and circular pin connectors. In view thereof, it should be understood that within the scope of the appended claims, the invention may be practiced otherwise than as specifically described herein.

I claim as my invention:

1. An electrical connector, which comprises:

a dielectric housing;

a plurality of insulated conductors positioned in said housing;

a first plurality of contact terminals, each said contact terminal positioned in said housing for piercing the insulation of an individual one of said plurality of insulated conductors in order to make electrical contact therewith; and a second plurality of contact terminals positioned in said housing for not piercing the insulation of and not electrically engaging any of said plurality of insulated conductors in said housing, but for permitting an electrical connection to be made thereto externally of said housing.

2. The electrical connector as set forth in claim 1, wherein said first and second plurality of contact terminals each comprise a substantially planar, electrically conductive contact terminal having tangs at the lower end thereof for enabling insulated conductors to be pierced, and a spring-contact mateable surface at the other end thereof for enabling contact portions of a mating connector to be coupled thereto.

3. The electrical connector as set forth in claim 2, wherein said first plurality of contact terminals are aligned in a first row, and said second plurality of contact terminals are aligned in a second row, said first and second rows being substantially parallel to each other.

4. The electrical connector as set forth in claim 2, wherein one of said first plurality of contact terminals is in substantially the same plane with one of said second plurality of contact terminals.

5. The electrical connector as set forth in claim 2, wherein each of said contact terminals of said first plurality are substantially parallel to each other, and each of said contact terminals of said second plurality are substantially parallel to each other.

6. The electrical connector as set forth in claim 5, wherein said contact terminals of said first and second plurality of contact terminals are positioned in aligned pairs consisting of one contact terminal from said first plurality and one contact terminal from said second plurality, each of said aligned pairs of contact terminals positioned in substantially the same plane.

7. The electrical connector as set forth in claim 6, further comprising a conductor in said housing for electrically connecting said first and second plurality of contact terminal.

8. The electrical connector as set forth in claim 7, wherein said conductor further includes a substrate positioned in said housing on which an electrically conductive path is positioned.

9. The electrical connector as set forth in claim 8, wherein said conductive path is adapted to be pierced by said first and second plurality of contact terminals.

10. The electrical connector as set forth in claim 9, wherein said conductive path comprises first and second sets of electrically conductive paths, said first set of paths adapted to be pierced by said first plurality of contact terminals, said second set of paths adapted to be pierced by said second plurality of contact terminals .

11. The electrical connector as set forth in claim 10, wherein said substrate further comprises a plurality of first electrical components positioned thereon and coupled to said first and second sets of electrically conductive paths.

12. The electrical connector as set forth in claim 11, wherein one of said plurality of first electrical components is coupled between one of said paths of said first set and one of said paths of said second set.

13. The electrical connector as set forth in claim 12, further comprising a second electrical component coupled between said one of said paths of said first set and said one of said paths of said second set.

14. The electrical connector as set forth in claim 11, wherein said plurality of first electrical components are connected respectively in series between said first set of electrically conductive paths and said second set of electrically conductive paths.

15. The electrical connector as set forth in claim 14, further comprising a plurality of second electrical components connected respectively in series with said plurality of first electrical components.

16. An electrical connector, which comprises:

a dielectric housing;

an insulated conductor positioned in said housing;

a substrate positioned in said housing and having first and second discrete electrically conductive paths positioned thereon and an electrical component connected between said first and second paths;

a first electrically conductive contact terminal positioned in said housing for piercing said insulated conductor and said first path; and a second electrically conductive contact terminal positioned in said housing for piercing said second path without piercing said insulated conductor and for permitting an electrical connection to be made thereto externally of said housing.

17. The electrical connector as set forth in claim 16, wherein said first and second electrically conductive contact terminals comprise first and second pluralities of substantially planar contact terminals, each of said contact terminals having tangs at the lower ends thereof capable of piercing the insulation of said conductor.

18. The electrical connector as set forth in claim 17, wherein said first and second pluralities of contact terminals are positioned in two adjacent, substantially parallel rows, respectively.

* * * * *